US006070306A

United States Patent [19]

Wang

[11] Patent Number: 6,070,306

[45] Date of Patent: Jun. 6, 2000

[54] STOP AND ZIPPER TEETH ARRANGEMENT

[76] Inventor: Wallace Wang, 1F., No. 30, Lane 252, San Jiunn Street, Shun Lin Chen, Taipei Hsien, Taiwan

[21] Appl. No.: 09/443,313

[22] Filed: Nov. 19, 1999

[51] Int. Cl.[7] ..... A44B 19/00

[52] U.S. Cl. ..... 24/436; 24/399; 24/429; 24/433

[58] Field of Search ..... 24/436, 433, 429, 24/419, 399, 400, 430, 437, 587

[56] References Cited

U.S. PATENT DOCUMENTS

| | | | |
|---|---|---|---|
| 2,573,059 | 10/1951 | Rabinow et al. | 24/436 |
| 3,077,651 | 2/1963 | Morin | 24/436 |
| 3,805,339 | 4/1974 | Howell | 24/436 |
| 4,023,241 | 5/1977 | Kanzaka | 24/436 |
| 5,860,193 | 10/1951 | Wang | 24/433 |

*Primary Examiner*—Victor N. Sakran
*Attorney, Agent, or Firm*—Varndell & Varndell, PLLC

[57] ABSTRACT

A top stop and zipper teeth arrangement for a zipper in which the top stop has a sloping bottom edge smoothly curved inwards and sloping downwardly backwards and terminating in a downward bottom projection, the sloping bottom edge defining with the topmost edge of the first tooth of the row of teeth on the longitudinal side rib of the zipper tape a gap through which the slide of the zipper is insert into engagement with the zipper tape; the first tooth having a stop wall portion at a top side of a neck thereof for preventing an inside partition wall of the slide from being moved into engagement with the neck of the first tooth when the slide is pulled downwards.

2 Claims, 9 Drawing Sheets

STOP AND ZIPPER TEETH ARRANGEMENT

BACKGROUND AND SUMMARY OF THE INVENTION

The present invention relates to zippers, and more specifically to a top stop and zipper teeth arrangement for a zipper, which prevents the slide from being jammed in the teeth when pulled downwards.

FIGS. 1 and 2 show the arrangement of a top stop on a zipper tape according to U.S. Pat. No. 5,860,193. According to this invention, the top stop comprises an upper stop block and a lower stop block. The lower stop block is connected to the first tooth of the row of teeth at the zipper tape. The upper stop block is spaced from the lower stop block at a distance. This top stop design enables the slide to be conveniently inserted through the gap between the upper stop block and the lower stop block into engagement with the zipper tape. However, because the lower stop block is disposed between the upper stop block and the row of teeth, the inside partition wall of the slide tends to be jammed in the lower stop block when the slide is pulled downwards from the upper stop block to open the zipper.

The present invention has been accomplished to provide a top stop and zipper teeth arrangement, which eliminates the aforesaid problem. It is the main object of the present invention to provide a top stop and zipper teeth arrangement, which prevents the slide from being jammed when pulled downwards to open the zipper. According to one aspect of the present invention, the top stop is a solid stop block formed integral with the longitudinal side rib at the zipper tape at one of the series of teeth on the zipper tape, having a sloping bottom edge smoothly inwards and defining with the topmost edge of the first tooth of the row of teeth on the zipper tape a gap through which the slide of the zipper is inserted into engagement with the zipper tape, and the first tooth of the row of teeth on the zipper tape comprises a stop wall portion at a top side of a neck thereof for preventing the inside partition wall of the slide from being moved into engagement with the neck of the first tooth when the slide is pulled downwards to open the zipper. According to another aspect of the present invention, the downward bottom projection of the top stop is suspended in the transverse distance between the back side edge of the base of the first tooth and the longitudinal central axis of the longitudinal side rib of the zipper tape, and the base of the first tooth has a sloping top edge sloping downwardly backwards toward the back side edge thereof for guiding the slide into position when the slide is inserted into the gap between the sloping bottom edge of the top stop and the topmost edge of the first tooth and turned into engagement with the zipper tape.

DETAILED DESCRIPTION OF THE PREFERRED EMBODIMENT

Figure 1:
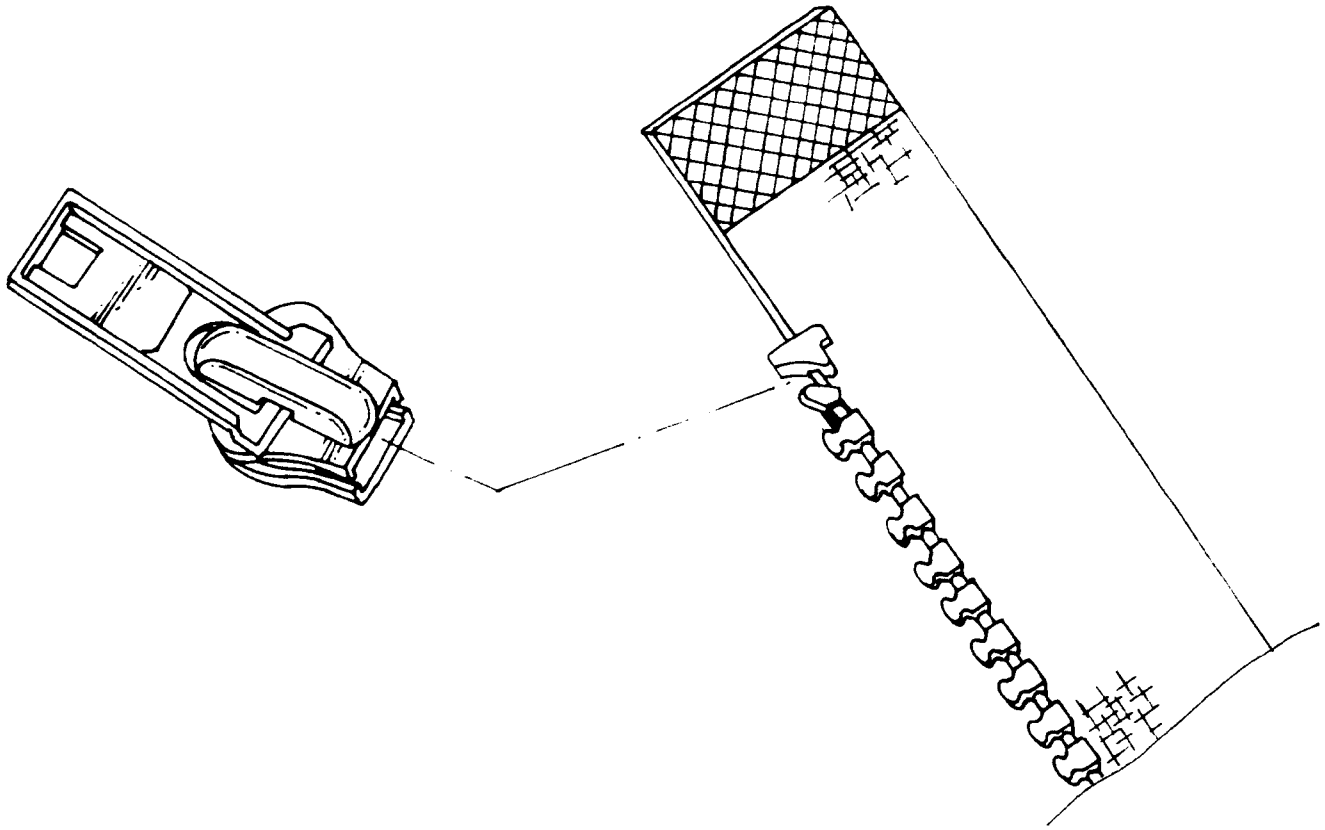
Fig. 1 PRIOR ART
FIG. 1 illustrates the arrangement of a top stop and a row of teeth on a zipper tape before the installation of a slide according to U.S. Pat. No. 5,860,193.
Figure 2:
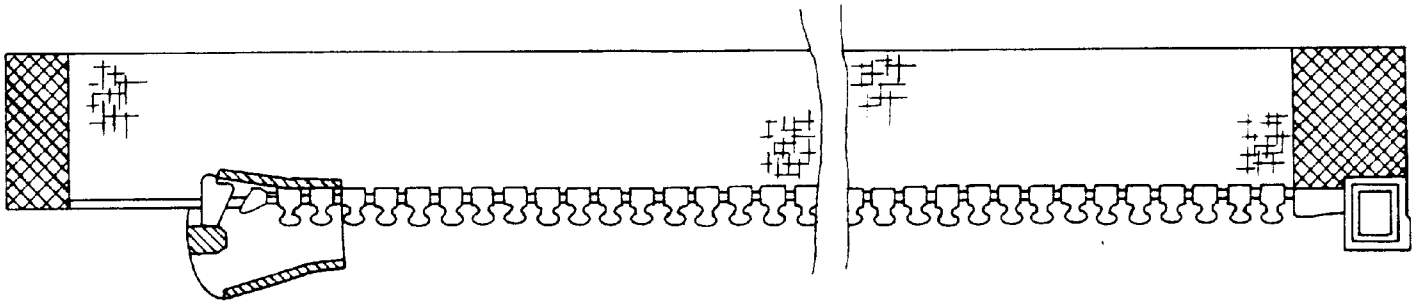
Fig. 2 PRIOR ART
FIG. 2 illustrates the slide installed in the zipper tape according to U.S. Pat. No. 5,860,193.
Figure 3:
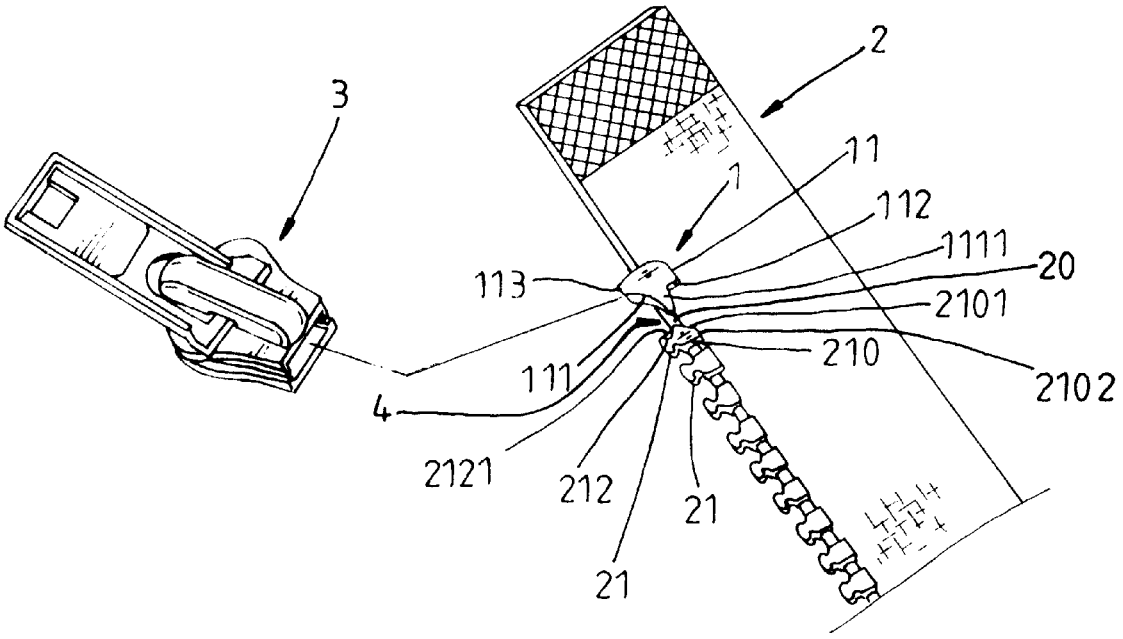
FIG. 3 illustrates the arrangement of a top stop and a row of teeth on a zipper tape before the installation of a slide according to the present invention.
Figure 4:
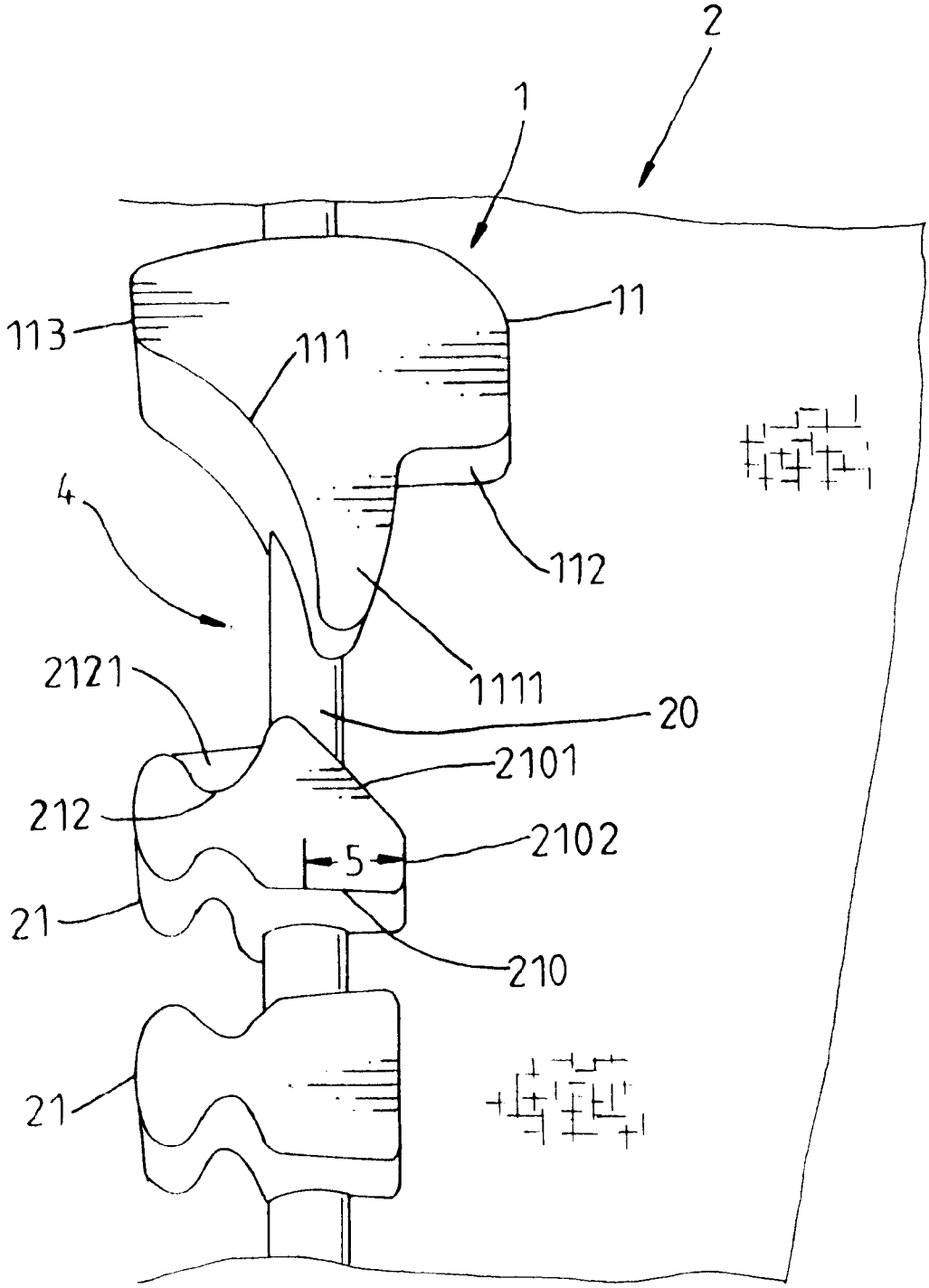
FIG. 4 is an enlarged view of a part of FIG. 3, showing the positioning of the top stop on the zipper tape relative to the first tooth.
Figure 5:
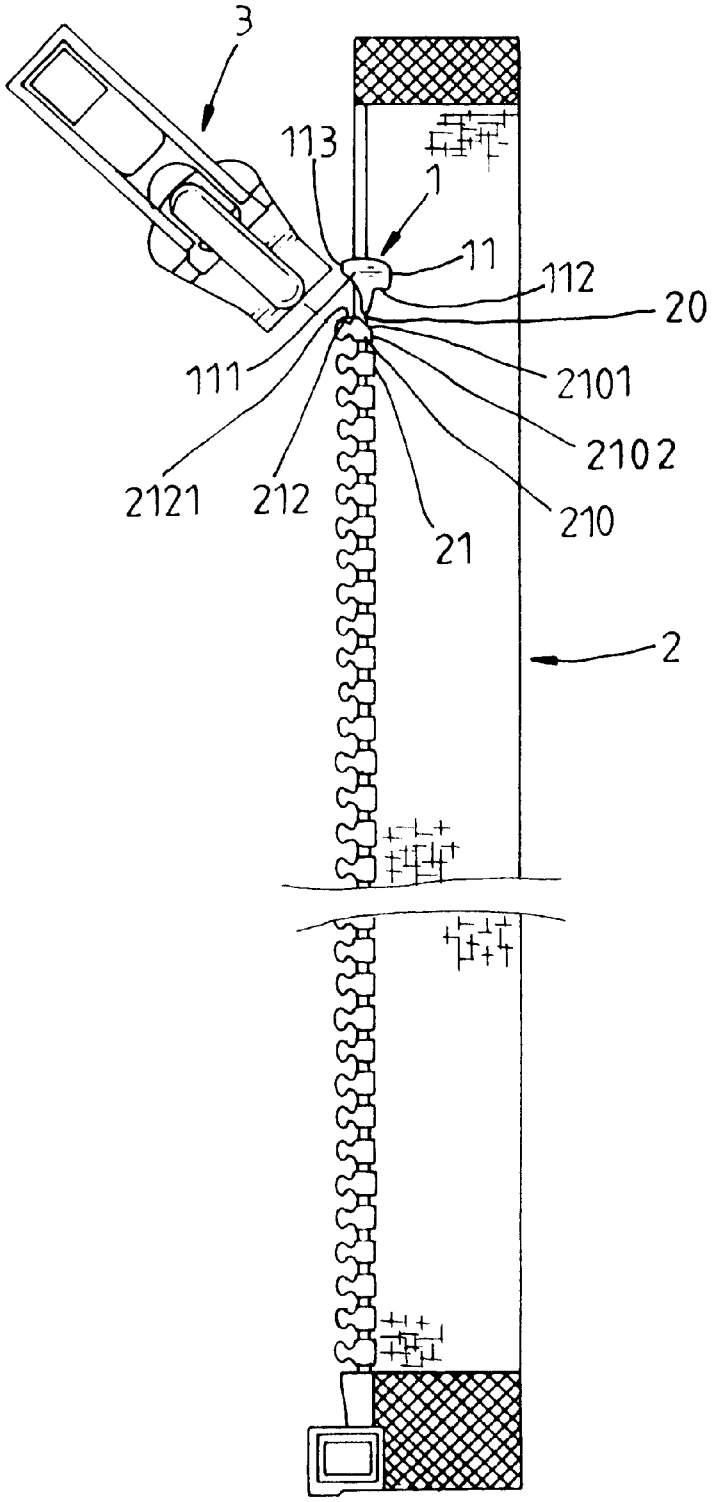
FIG. 5 is a top view of the preferred embodiment of the present invention before the installation of the slide.
Figure 6:
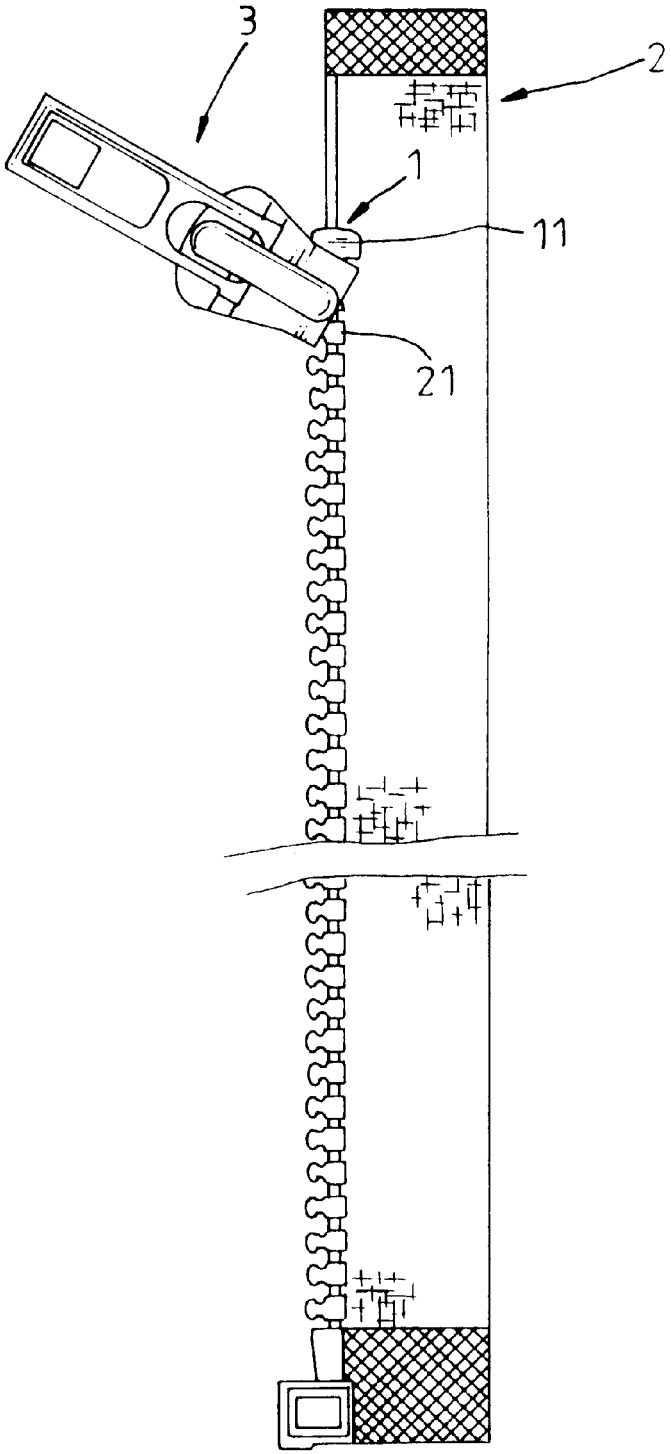
FIG. 6 is similar to FIG. 5, but showing the slide inserted into the gap between the stop block and the first tooth.
Figure 7:
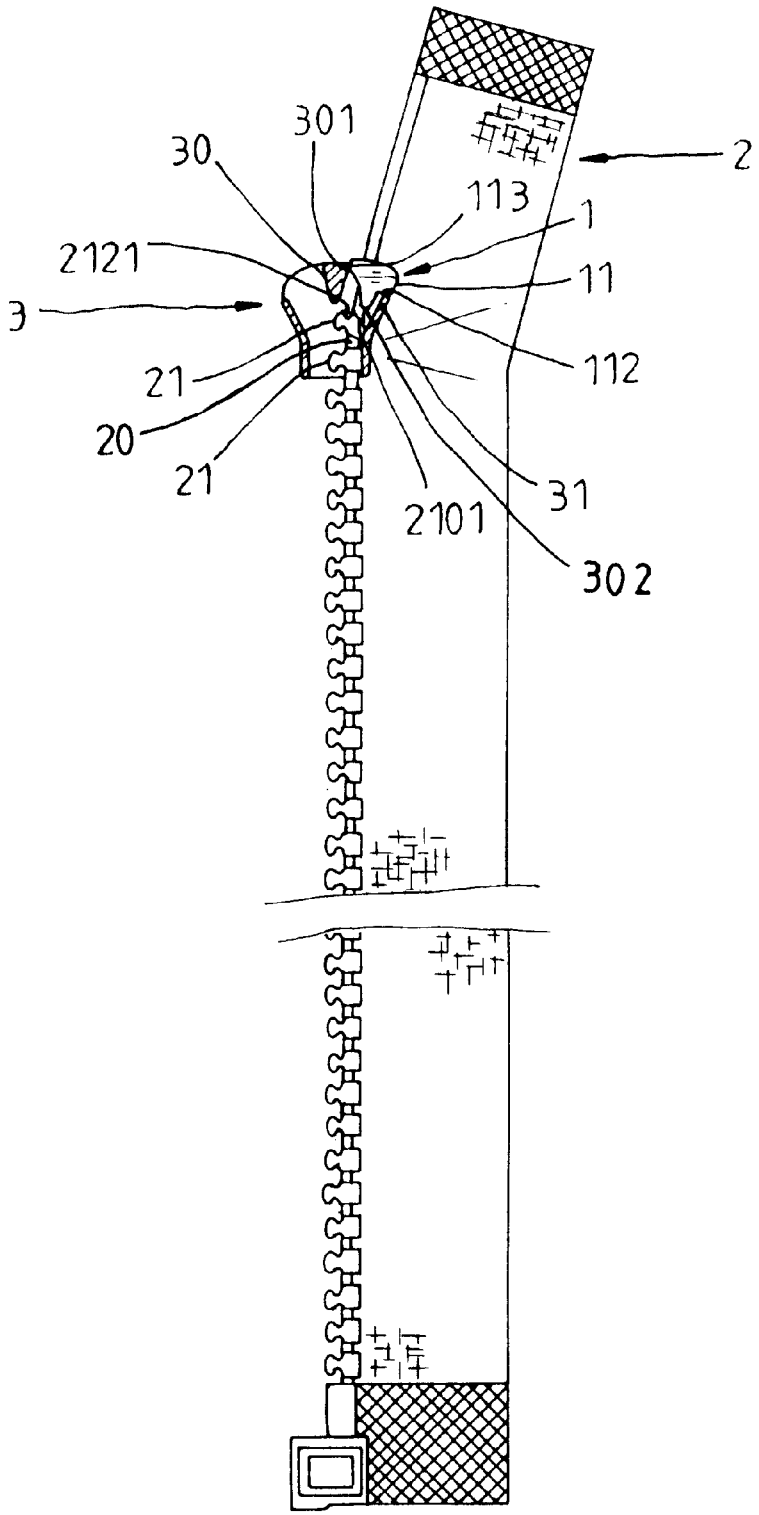
FIG. 7 is a sectional view showing the slide coupled to the teeth on the zipper tape and stopped below the stop block according to the present invention.
Figure 8:
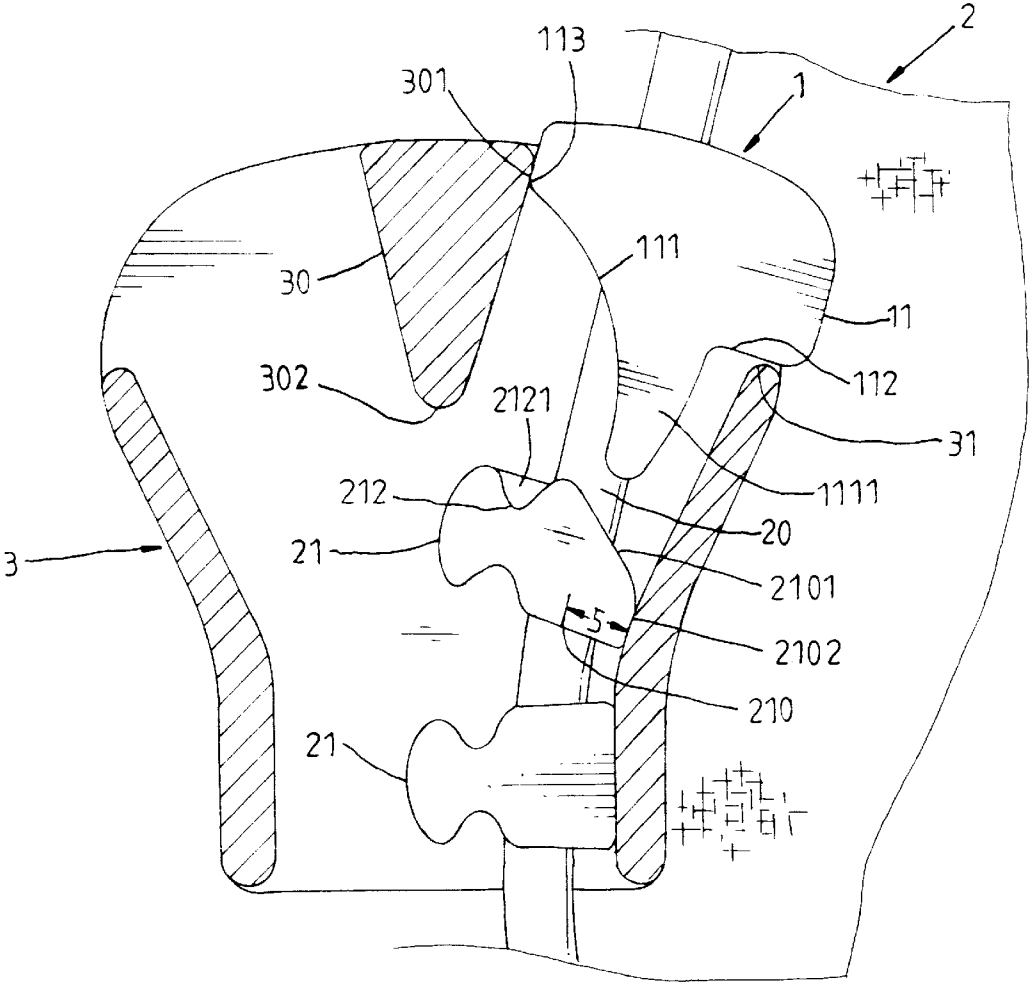
FIG. 8 is an enlarged view of a part of FIG. 7.
Figure 9:
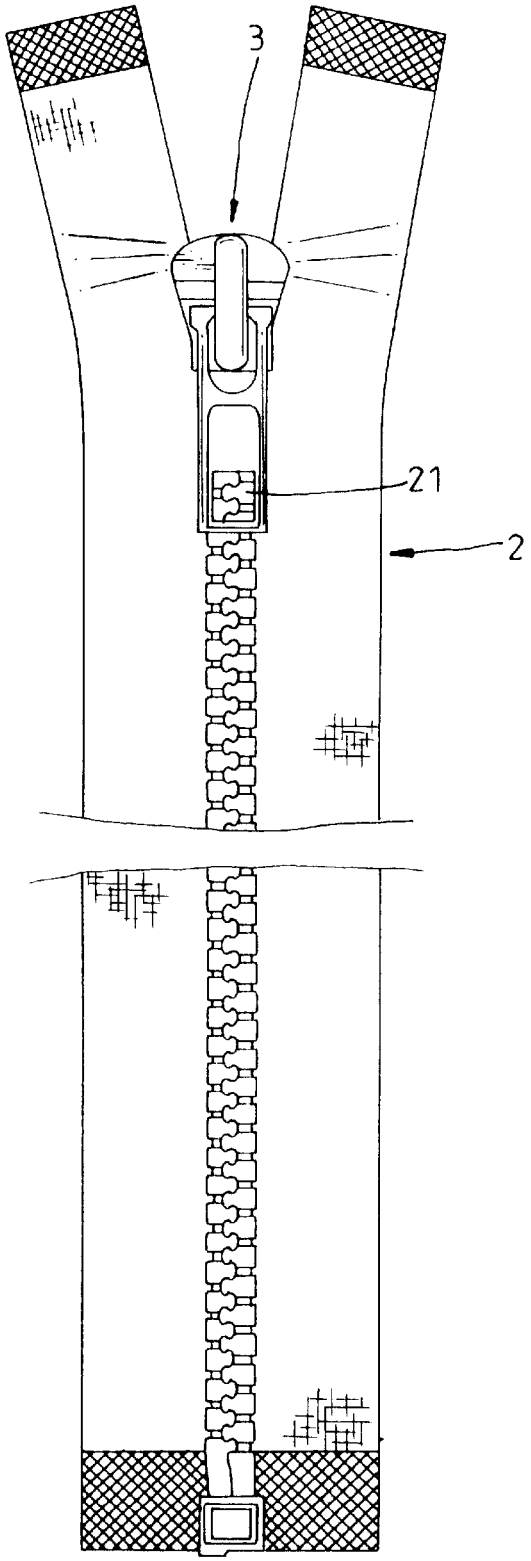
FIG. 9 is a plain view of the present invention, showing slide pulled to the upper limit position.

Referring to FIGS. from 3 through 9, a top stop 1 is injection-molded on a zipper tape 2 at one end of the row of teeth 21 of the zipper tape 2. The top stop 1 comprises a stop block 11. The transverse length of the stop block 11 is greater than the length of the teeth 21. The stop block 11 comprises a sloping bottom edge 111 curved inwardly downwards and terminating in a downward bottom projection 1111, a from stop face 113 at the front side thereof remote from the zipper tape 2, and a rear stop projection 112 at the rear side thereof on the zipper tape 2. When the slide 3 is pulled to the upper limit position after installation, the rear stop projection 112 of the stop block 11 is stopped at a top edge 31 of the slide 3, and the front stop face 113 of the stop block 11 is stopped at one side 301 of an inside partition wall 30 of the slide 3, and therefore the slide 3 is stopped from escaping out of the constraint of the top stop 1.

The sloping bottom edge 111 of the stop block 11 defines with the topmost edge of the first tooth 21 a gap 4. Because the sloping bottom edge 111 curves smoothly inwards, the slide 3 can easily be inserted through the gap 4 into engagement with the zipper tape 2. This design enables the inside partition wall 30 of the slide 3 to be disposed close to the teeth 21, and prevents the slide 3 from being jammed in the first tooth 21 when pulled downwards from the upper limit position. The first tooth 21 comprises a stop wall portion 2121 at the top side of the neck 212 thereof, which prevents the bottom edge 302 of the inside partition wall 30 of the slide 3 from being moved into engagement with the neck 212 of the first tooth 21 when the slide 3 is pulled downwards from the upper limit position.

The downward bottom projection 1111 of the stop block 11 is suspended in the transverse distance 5 between the back side edge 2102 of the base 210 of the first tooth 21 and the longitudinal central axis of the longitudinal side rib 20 of the zipper tape 2. Further, the base 210 of the first tooth 21 has a sloping top edge 2101 sloping downwardly backwards toward the back side edge 2102 for guiding the slide 3 into position when the slide 3 is inserted into the gap 4 and turned into engagement with the zipper tape 2. After installation, the downward bottom projection 1111 of the stop block 11 prevents the slide 3 from escaping out of the row of teeth 21 on the zipper tape 2.

As indicated below, the top stop 1 is simply comprised of a stop blcok 11 integral with the zipper tape 2, and the first tooth 21 comprises a stop wall portion 2121 at the top side of the neck 212 thereof, sliding the slide 3 downwards from the upper limit position does not causes the slide 3 to be jammed in the first tooth 21. Further, because the downward bottom projection 1111 of the stop block 11 is suspended in the transverse distance 5 between the back side edge 2102 of the base 210 of the first tooth 21 and the longitudinal central axis of the longitudinal side rib 20 of the zipper tape 2 and, the base 210 of the first tooth 21 has a sloping top edge 2101 sloping downwardly backwards toward the back side edge 2102, the slide 3 can smoothly be guided into engagement with the zipper tape 2 when inserted into the gap 4 between the stop block 11 and the first tooth 21.

What is claimed is:

1. A top stop and zipper teeth arrangement comprising a zipper tape having a longitudinal side rib, a plurality of teeth molded on said zipper tape in a row along said longitudinal side rib, a slide sliding on said row of teeth, said slide having an inside partition wall, and a top stop disposed at said zipper tape at one end of said row of teeth to stop said slide from escaping out of said row of teeth, said teeth including a first tooth disposed adjacent to said top stop, said top stop comprising a front stop face disposed at a front side thereof remote from said zipper tape, which is stopped at one side of the inside partition wall of said slide when said slide is pulled upwards towards said top stop, a rear stop projection disposed at a rear side thereof on said zipper tape, which is stopped at a top edge of said slide when said slide is pulled upwards toward said top stop, and a sloping bottom edge extended downwards from said front stop face and terminating in a downward bottom projection, wherein the sloping bottom edge of said top stop curves smoothly inwards, defining with the topmost edge of said first tooth a gap through which said slide is inserted into engagement with said zipper tape; said first tooth comprises a stop wall portion at a top side of a neck thereof for preventing the inside partition wall of said slide from being moved into engagement with the neck of said first tooth when said slide is pulled downwards.

2. The top stop and zipper teeth arrangement of claim 1 wherein said downward bottom projection of said top stop is suspended in the transverse distance between the back side edge of the base of said first tooth and the longitudinal central axis of the longitudinal side rib of said zipper tape, and the base of said first tooth has a sloping top edge thereof for guiding said slide into position when said slide is inserted into the gap between the sloping bottom edge of said top stop and the topmost edge of said first tooth and turned into engagement with said zipper tape.

* * * * *